US007086620B2

(12) United States Patent
Okuya

(10) Patent No.: US 7,086,620 B2
(45) Date of Patent: Aug. 8, 2006

(54) ALUMINUM SHEARING APPARATUS

(76) Inventor: Yasuaki Okuya, 52 Soramachi, Heisaka-Cho, Nishio-City, Aichi-Pref., 444-0305 (JP)

( * ) Notice: Subject to any disclaimer, the term of this patent is extended or adjusted under 35 U.S.C. 154(b) by 28 days.

(21) Appl. No.: 10/941,923

(22) Filed: Sep. 16, 2004

(65) Prior Publication Data

US 2005/0061900 A1 Mar. 24, 2005

(30) Foreign Application Priority Data

Sep. 18, 2003 (JP) ..... 2003-326362

(51) Int. Cl.
*B02C 17/14* (2006.01)

(52) U.S. Cl. ..... 241/264

(58) Field of Classification Search ..... 241/264, 241/265, 266, 267, 268, 269
See application file for complete search history.

(56) References Cited

U.S. PATENT DOCUMENTS 5,044,569 A * 9/1991 LaBounty et al. ..... 241/266
5,533,682 A * 7/1996 de Gier et al. ..... 241/101.73
5,791,573 A 8/1998 Okuya
6,145,768 A * 11/2000 Okuya ..... 241/265
6,764,036 B1 * 7/2004 Okuya ..... 241/264

FOREIGN PATENT DOCUMENTS

| | | | |
|---|---|---|---|
| EP | 0 865 825 A1 | | 9/1998 |
| GB | 2239409 | * | 7/1991 |
| JP | 6-106083 | | 4/1994 |
| JP | 6-182238 | | 7/1994 |

* cited by examiner

*Primary Examiner*—Faye Francis
(74) *Attorney, Agent, or Firm*—Armstrong, Kratz, Quintos, Hanson & Brooks, LLP

(57) ABSTRACT

The present invention relates to a shearing apparatus for shearing aluminum including one cutting edge unit rotatably attached to an upper portion of a frame and a second cutting edge unit being opposed to the one cutting edge unit and being rotatably attached to a lower portion of the frame. Half-cut pyramid-shaped cutting edges are arranged on the one cutting edge unit in a zigzag manner half-cut pyramid-shaped cutting edges arranged on the second cutting edge unit in a zigzag manner. A device capable of moving the second cutting edge unit in a shearing manner, and an input opening for feeding aluminum and a discharge opening are part of the structure, with clearances for shearing being provided between the half-cut pyramid-shaped cutting edges of the one and the second cutting edge unit.

4 Claims, 13 Drawing Sheets

ALUMINUM SHEARING APPARATUS

TECHNICAL FIELD

The present invention relates to an aluminum (including aluminum alloy, gun metal) shearing (partly including crushing and breaking) apparatus.

BACKGROUND ART

Hitherto, the present applicant filed a number of applications relating to crushing-breaking apparatus for useless metal casting products. For example, there are an apparatus for crushing-breaking weirs, runners, and other defect products, generated by hydraulic metal casting according to JP-A-6-106083 as Patent Document 1, a method for crushing-breaking irregular weirs, runners, and other defect products generated by metal casting according to JP-A-6-182238 as Patent Document 2, a CRUSHING-BREAKING APPARATUS in U.S. Pat. No. 5,791,573 as Patent Document 3, and A method and apparatus for crushing-breaking long and slender weirs, runners, and other useless metal casting products in Europe Patent No. 0865825 as Patent Document 4. These literatures are referred to as an Outline of Presented Literatures 1.

[Patent Document 1] JP-A-6-106083

[Patent Document 2] JP-A-6-182238

[Patent Document 3] U.S. Pat. No. 5,791,573

[Patent Document 4] Europe Patent No. 0865825

DISCLOSURE OF THE INVENTION

Problems to be Solved by the Invention

In any of the literatures in Outline 1, the object is the useless metal casting product in any cases, and hence significant clearances are formed between left and right base portions and/or conical surfaces of respective one and the other half-cut conical cutting edges. This technology is to crush and break utilizing these clearances. An object of securing such clearances is as follows. (1) to accommodate strength and viscosity of metal casting, (2) to secure a suitable size for feeding in a furnace, and (3) to secure durability of the one and the other half-cut conical cutting edges.

However, when shearing aluminum, the characteristics in (1) to (3) described above cause harmful effects. The reasons are: (a) Aluminum can be cut with a light force, and this condition is required, (b) since it is soft in physical property, shearing process is ideal, and (c) a load exerted on the cutting edge is small, and hence a strong sense of fitting is not necessary.

Advantages of the Invention

The invention according to claim 1 is an aluminum shearing apparatus including:

a frame having two side plates;

one cutting edge unit provided between the two frames and rotatably attached at the upper portion thereof;

the other cutting edge unit opposing to the one cutting edge unit, and being rotatably attached at the lower portion thereof between the two frames so that the upper portion is movable;

half-cut pyramid-shaped cutting edges disposed respectively on the one cutting edge unit and the other cutting edge unit in a zigzag manner;

movable means supported by a beam plate supported between the frames for moving the other cutting edge unit;

distal crests provided respectively on the distal sides of the respective half-cut pyramid-shaped cutting edges;

clearances for shearing provided between the half-cut pyramid-shaped cutting edges of the one cutting edge unit and the other cutting edge unit;

movable means for adjusting the opening for moving the lower portion of the one cutting edge unit;

an input opening provided above the one cutting edge unit and the other cutting edge unit; and a discharge opening provided below the one cutting edge unit and the other cutting edge unit.

Therefore, claim 1 has characteristics such that; (a) a slight force that is required for cutting aluminum can be secured; (b) shearing process is performed by utilizing its softness in physical property and efficiency of the process can be improved; and (c) a load exerted to the cutting edges is reduced, and a strong sense of fitting can be eliminated. It is also effective in that a shearing apparatus optimal for shearing aluminum can be provided by the provision of slight clearances for shearing between the half-cut pyramid-shaped cutting edges of the one and the other cutting edge units.

The invention according to claim 2 is an aluminum shearing apparatus according to claim 1, wherein a supporting shaft for rotatably attaching the lower portion of the other cutting edge unit provided between the two frames includes eccentric bearings provided on the frames.

Therefore, claim 2 can achieve the object of claim 1. In view of a fact that shearing of aluminum can be performed sufficiently with a relatively small power, by improving the supporting shaft for rotatably attaching the other cutting edge unit, multi-purpose function can advantageously be provided to the other cutting edge unit.

The invention according to claim 3 is an aluminum shearing apparatus according to claim 1, wherein the supporting shaft provided between the two frames for rotatably attaching the lower portion of the other cutting edge unit is provided on the eccentric bearings provided on the frames, and the eccentric bearing includes frame holes formed on the frames, a number of supporting blocks inserted into the frame holes, eccentric bearings provided between the number of supporting blocks, and stoppers for stopping the rotation of the eccentric bearings.

Therefore, claim 3 can achieve the object of claim 1. In order to achieve the object, a shaft supporting structure for rotatable attachment optimal for the other shearing edge unit can advantageously be provided.

The invention according to claim 4 is an aluminum cutting apparatus according to claim 1 including projecting ridges formed at least on the top surfaces of the half-cut pyramid-shaped cutting edge of the one and the other cutting edge unit provided between the two frames.

Therefore, claim 4 can achieve the object of claim 1. In order to achieve this object, a half-cut pyramid-shaped cutting edge structure optimal for the one and the other cutting edge unit can advantageously be provided.

EMBODIMENTS

An embodiment of the present invention will be described.

Referring to the drawings, an embodiment of a shearing apparatus used for a method of the present invention will be described. A shearing apparatus 1 mainly includes a frame 3 opening on top and bottom and including side plates 2*a*, 2*b* and a beam plate 2*c*, one cutting edge unit 4 and the other cutting edge unit 5 provided in the frame 3, and a cylinder 6 for moving the other cutting edge unit 5 forward and backward. An input opening A is formed at a free end (upper side) of the one cutting edge unit 4 and the other cutting edge unit 5, and a discharge opening B is formed at a proximal end (lower side) of the one cutting edge unit 4 and the other cutting edge unit 5. The beam plate 2*c* supports the other cutting edge unit 5.

The one cutting edge unit 4 includes a base plate 40 for mounting the cutting edge base provided on the frame 3, a cutting edge base 41 detachably provided on the base plate 40, a number of half-cut pyramid-shaped cutting edges 42 (fixed side) arranged in a zigzag manner on the cutting edge base 41. A pyramid-shaped inclined surface 42*a* of the half-cut pyramid-shaped cutting edge 42 is characterized in that sheared aluminum can drop positively and smoothly, in that durability and shearing function of the half-cut pyramid-shaped cutting edge 42 are maintained, in that shearing of wasted aluminum material aluminum during process (processing aluminum) is ensured, and in that the useless aluminum and processing aluminum (including unprocessed aluminum) can be received. A back surface 42*c* of the half-cut pyramid-shaped cutting edge 42 is formed with a protruding bottom 43. The protruding bottom 43 contributes to maintain durability of the half-cut pyramid-shaped cutting edge 42 and shearing function in cooperation with a half-cut pyramid-shaped cutting edge 52 on the other cutting edge unit 5 (moving side) described later, or to ensure shearing of processing aluminum. As an example, by providing a distal crest 44 on a distal side 42*d* of the half-cut pyramid-shaped cutting edge 42, it can also be utilized for preventing aluminum from flying in all directions and/or for applying pressure. The distal crests 44 are provided on two rows of the half-cut pyramid-shaped cutting edges 52 from the top (input opening A), considering prevention of aluminum from flying in all directions, maintaining its durability, and shearing relation with respect to the half-cut pyramid-shaped cutting edge.

The other cutting edge unit 5 (moving side) includes a base plate 50 for mounting the cutting edge base provided on the frame 3, a cutting edge base 51 detachably provided on the base plate 50, and a number of half-cut pyramid-shaped cutting edges 52 (fixed side) provided on the cutting edge base 51 arranged in a zigzag manner. A pyramid-shaped inclined surface 52*a* of the half-cut pyramid-shaped cutting edge 52 is characterized in that sheared aluminum can drop positively and smoothly, in that durability and shearing function of the half-cut pyramid-shaped cutting edge 52 are maintained, in that shearing of processing aluminum is ensured, and in that the processing aluminum can be received. A square-shaped projecting ridge 52*b* is formed on the top surface of the half-cut pyramid-shaped cutting edge 52. It is also possible to form a square shaped projecting ridge (not shown) on both of skirt portions or the back surface of the half-cut pyramid-shaped cutting edge 52, respectively. The projecting ridge 52*b* has advantages in that processing aluminum can positively sheared, processing aluminum can be received, and so on. It is also possible to form a protruding bottom 53 on a back surface 52*c*, so that durability and shearing function of the half-cut pyramid-shaped cutting edge 52 can be maintained, or processing aluminum can positively be shared. In addition, by providing a distal crest 54 on a distal side 52*d*, it can be utilized for preventing processing aluminum from flying in all directions and/or applying pressure. By providing the projecting ridges 52*b* on two rows of half-cut pyramid-shaped cutting edges 52 from the top of the other cutting edge unit 5, prevention of aluminum from flying in all directions, maintenance of its durability, and shearing relation with respect to the half-cut pyramid-shaped cutting edge 42 can be secured.

The distal crests 54 described above are formed on two rows of the half-crest pyramid-shaped cutting edges 52 from the top considering prevention of aluminum from flying in all directions, maintaining its durability, and shearing relation with respect to the half-cut pyramid-shaped cutting edge 52. Reference numeral 52-1 in the drawing designates a half-cut pyramid-shaped cutting edge having no square shaped projecting ridge 52*b* on the top surface of the half-cut pyramid-shaped cutting edge 52. In this example, as described above, they are formed on the other cutting edge unit 5 from the third rows from the top. Provision of the pyramid-shaped inclined surface 52*a* on the half-cut pyramid-shaped cutting edge 52-1 is the same as in the case described above.

The half-cut pyramid-shaped cutting edges 52 of the other cutting edge unit 5 are formed between the half-cut pyramid-shaped cutting edges 42 of the one cutting edge unit 4 in a fitting relation via slight clearances C referred to as clearances C), so that aluminum is shared by these clearances C. Also, by providing lateral clearances D (referred to as clearances D) formed with respect to the pyramid-shaped inclined surfaces 42*a* of the half-cut pyramid-shaped cutting edges 42 and/or the protruding bottoms 53 of the half-cut pyramid-shaped cutting edges 52, or lateral clearances (not shown) formed with respect to the pyramid-shaped inclined surfaces 52*a* of the half-cut pyramid-shaped cutting edges 52 and/or protruding bottoms 43 of the half-cut pyramid-shaped cutting edges 42, maintenance of durability and shearing function of the half-cut pyramid-shaped cutting edges 42, 52, positive shearing of processing aluminum, or promotion of dropping of processing aluminum can be ensured, as described above.

Although not shown, it is also possible to provide a damper, which can be opened and closed freely, at the discharge opening B for preventing passage without being processed and clogging of aluminum using the damper, and the damper is attached to either one of the frame of the shearing apparatus 1, the one cutting edge unit 4, or the other cutting edge unit 5.

The distal end of a piston rod 60 of the cylinder 6 is rotatably attached on the upper portion of the base plate 50 of the other cutting edge unit 5. Therefore, the other cutting edge unit 5 can be moved via expansion and contraction of the piston rod 60 (moved in the fore-and-aft direction). This movement is based on a lever mechanism about a supporting shaft 8 as a fulcrum, and is sufficient with a relatively small power. The half-cut pyramid-shaped cutting edge 52 of the other cutting edge unit 5 and the half-cut pyramid-shaped cutting edge 42 of the one cutting edge unit 4 are brought into a fitted relation with the intermediary of clearances C by the forward movement of the other cutting edge unit 5, thereby shearing (cutting) aluminum. When shearing, the clearance size of the clearance C plays an important role, and the shearing clearance is set to a value close to zero. This shearing process is extremely effective for after-processing of aluminum.

The supporting shaft 8 of the other cutting edge unit 5 is supported by the use of bearings 80, and supporting blocks 81 to be fitted into frame holes 30 formed into a large size on the frame 3. Therefore, by adjusting the number of supporting blocks 81 on the left and right sides of the frame holes 30 by inserting and removing of the supporting blocks 81 to be fitted into the frame holes 30, the position of the supporting shaft 8 can be changed. Accordingly, adjustment of the opening of the input opening A and/or the opening of the discharge opening B, adjustment of pressing force of the other cutting edge unit 5, and ease of repair in case of failure. The bearing 80 is provided with a metal 82, an eccentric bush 83, and a stopper 84. Therefore, by releasing the stopper 84, the eccentric bush 83 can be rotated as needed to change the position of the supporting shaft 8. After having changed the position, the supporting shaft 8 is tightened (at this rotational position) with the stopper 84 to fix the eccentric bush 83. With this operation, the position of the supporting shaft 8 is changed so that the supporting shaft 8 is fixed at the changed position. For example, it can be changed to the state as shown in FIGS. 10(*a*),(*b*) to FIGS. 11(*a*),(*b*). With such changes, the opening of the discharge opening B and/or the movable position (fore-and-aft movement) of the other cutting edge unit 5, or the fitting relation between the half-cut pyramid-shaped cutting edges 42 of the one cutting edge unit 4 and the half-cut pyramid-shaped cutting edges 52 of the other cutting edge unit 5 is adjusted. The position of the supporting shaft 8 can be changed by changing the number of the supporting blocks 81 on the left and right sides in the frame holes 30, as a matter of course. The eccentric bush 83 can be removed by cutting the bearing 80 into halves.

It is also possible to make the lower portion of the one cutting edge unit 4 movable, and an example of which is shown in FIG. 15. In other words, a pivot shaft 9 is provided on the upper portion thereof, and the upper portion of the one cutting edge unit 4 is rotatably attached to the pivot shaft 9. Then, movable means such as a link 90 rotatably attached to the one cutting edge unit 4, a cylinder 91, or a piston rod 92 rotatably attached to the link 90 is provided on the lower portion thereof, so that the lower portion of the one cutting edge unit 4 can be moved by this movable means. The movement of the one cutting edge unit 4 has the same characteristic as the movement of the other cutting edge unit 5.

Reference numeral 100 designates a base plate for supporting the aluminum shearing apparatus, reference numeral 101 designates a conveyer for transporting useless aluminum material, and reference numeral 102 designates a shooter, respectively.

Describing an example of feeding and shearing operation of aluminum, aluminum is fed to the input opening A defined by the half-cut pyramid-shaped cutting edges 52 (or the surfaces thereof) of the other cutting edge unit 5 and the half-cut pyramid-shaped cutting edge 42 of the one cutting edge unit 4 in a state in which the half-cut pyramid-shaped cutting edge 42 of the one cutting edge unit 4 is located on the rear limit. Thereafter, the upper portion of the other cutting edge unit 5 moves forward along an arcuate track about the supporting shaft 8, so that the half-cut pyramid-shaped cutting edges 52 (pushing edges) of the other cutting edge unit 5 and the half-cut pyramid-shaped cutting edges 42 of the one cutting edge unit 4 (receiving edge) are brought into the fitted relation, where shearing operation is performed. For example, shearing of aluminum is performed via the fitting between the projecting ridges 52*b* and/or the protruding bottoms 53 of the half-cut pyramid-shaped cutting edges 52 of the other cutting edge unit 5 and projecting ridges 42*b* and/or the protruding bottoms 43 of the half-cut pyramid-shaped cutting edge 42 of the one cutting edge unit 4 (hereinafter, the one cutting edge unit 4 and the other cutting edge unit 5 are referred to as both units). Then, since the clearances C formed between the projecting ridges 52*b* and the projecting ridges 42*b* of the both units are extremely narrow, aluminum can be sheared positively and efficiently. The projecting ridges 52*b* and the projecting ridges 42*b* also contribute to prevent downward slip of aluminum. Therefore, the projecting ridges 52*b* and the projecting ridges 42*b* are characterized in that they catch aluminum fed from the input opening A, and prevent aluminum from passing through the discharge opening B without being processed. The fact that a number of projecting ridges 52*b* and projecting ridges 42*b* have the same effect as rib cutting edges 420, 520 extending among the half-cut pyramid-shaped cutting edges 42 or among the half-cut pyramid-shaped cutting edges 52, that the distal crests 44, 54 of the half-cut pyramid-shaped cutting edges 42, 52 have shearing and pushing effects and hence contribute to prevent aluminum from flying in all directions, and hence achieve efficient shearing are also characteristics. The sheared aluminum is transported to suitable locations from transporting means (not shown) from the discharge opening B.

The invention is efficient since shearing is performed in clearances E between the half-cut pyramid-shaped cutting edges 52 and the cutting edge base 41, and clearance F between the half-cut pyramid-shaped cutting edge 42 and/or distal crests 44 and the cutting edge base 51. These clearances E are characterized in that extremely narrow state can be secured, and the structure which can secure these extremely narrow clearances is employed. In other words, the structure in which shearing can be performed peripheries of all the half-cut pyramid-shaped cutting edges 42, 52 is employed.

At the timing when the shearing operation is terminated, the upper portion of the other cutting edge unit 5 is moved rearward along the arcuate track about the supporting shaft 8, so that fitting relation between the half-cut pyramid-shaped cutting edges 52 of the other cutting edge unit 5 and the half-cut pyramid-shaped cutting edge 42 of the one cutting edge unit 4 are released, and the input opening A is opened and returned to the initial state.

BRIEF DESCRIPTION OF THE DRAWINGS

FIG. 1 is a plan view showing an example of an aluminum shearing apparatus according to the present invention.

FIG. 2 is a side view of the example in FIG. 1.

FIG. 3 is a front view of one cutting edge unit of the example in FIG. 1.

FIG. 4 is a side view of the one cutting edge unit of the example in FIG. 1.

FIG. 5 is a front view of the other cutting edge unit of the example in FIG. 1.

FIG. 6 is a side view of the other cutting edge unit of the example in FIG. 1.

FIG. 7 is an enlarged view of the one and the other half-cut pyramid-shaped cutting edges of the example in FIG. 1, wherein (a) is a front view, (b) is an overhead view, and (c) is a side view.

FIG. 8 shows the other half-cut pyramid-shaped cutting edges of the example in FIG. 1 illustrating an enlarged structure suitable for the first row and the second row of the other cutting edge unit, wherein (a) is a side view and (b) is a plan view.

FIG. 9 is an enlarged view showing the fitting relation between the one and the other half-cut pyramid-shaped cutting edges of the example in FIG. 1, wherein (a) is a side view and (b) is a plan view.

FIG. 10 is a drawing showing an example in which a supporting shaft is provided in the other cutting edge unit in FIG. 1, wherein (a) is a perspective view showing a state in which a discharge opening is opened to a minimum extent, and (b) is a front view of an eccentric bush.

FIG. 11 is an enlarged view showing an example in which the supporting shaft is provided on the other cutting edge unit in FIG. 1 wherein (a) is a perspective view showing a state in which the discharge opening is opened to a maximum extent, and (b) is a front view of the eccentric bush.

FIG. 12 is a side view of (b) in FIG. 10.

FIG. 13 is a back view of the example in FIG. 1.

FIG. 14 is a side view in a reduced scale showing an example in FIG. 1 in use.

FIG. 15 is a side view of the aluminum shearing apparatus showing another example of the example in FIG. 1.

Figure 1:
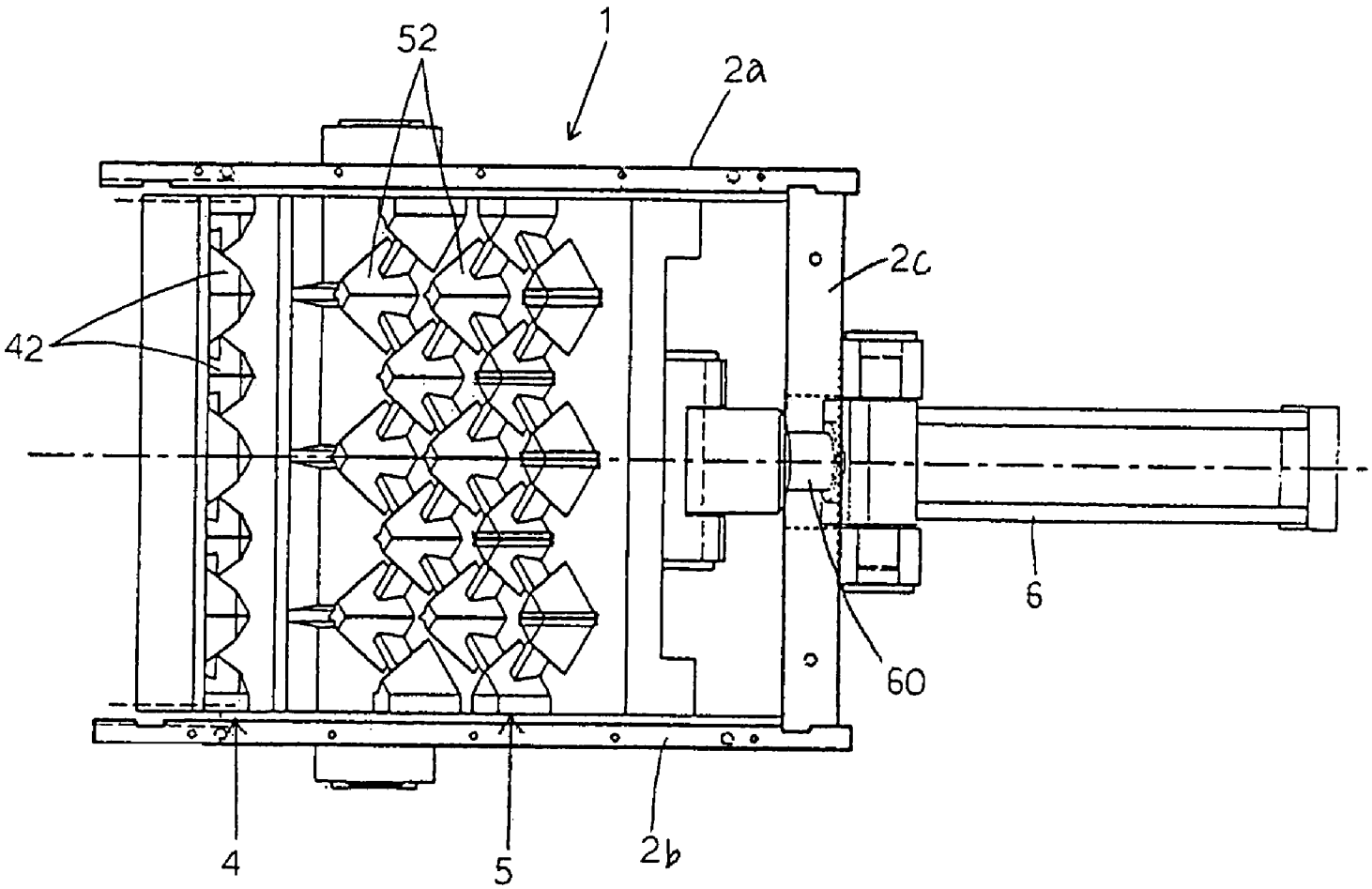
[FIG. 1]
Figure 2:
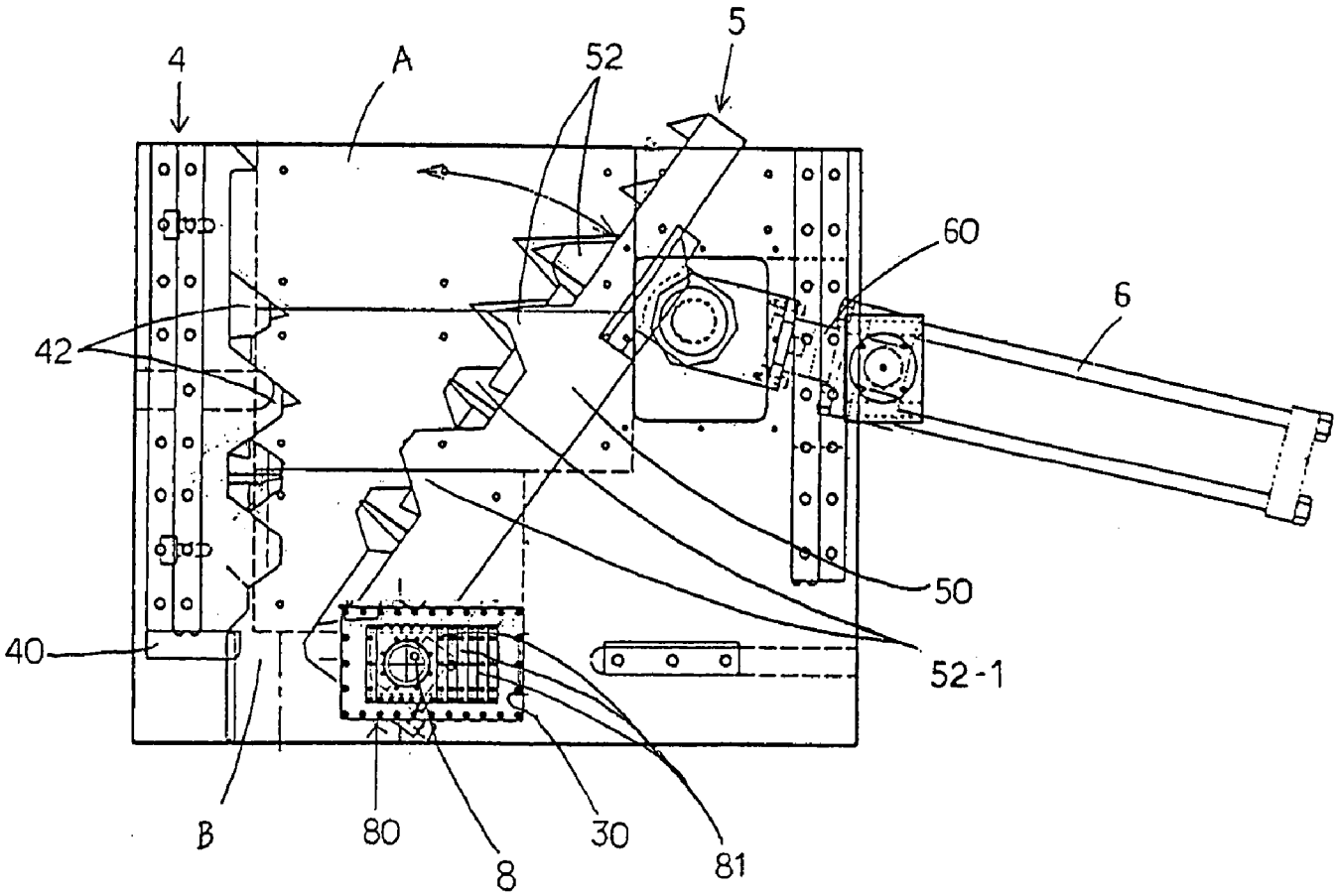
[FIG. 2]
Figure 3:
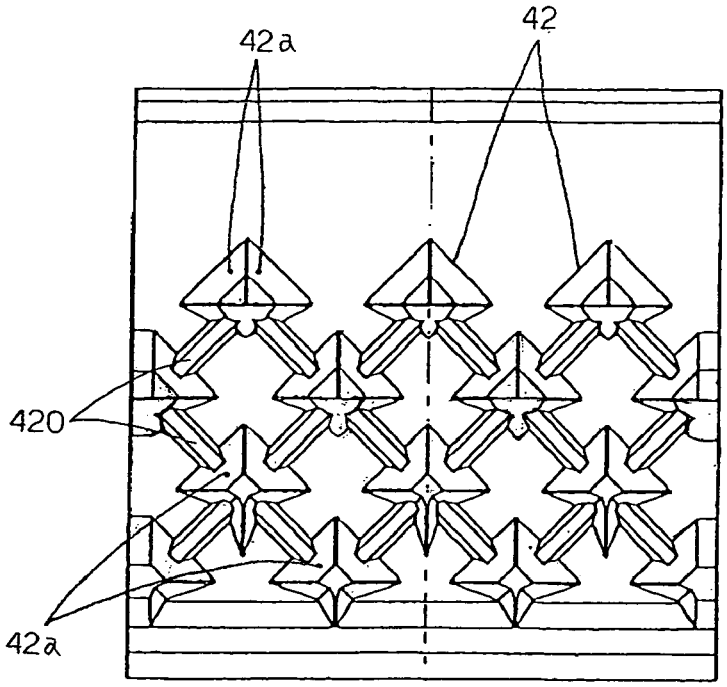
[FIG. 3]
Figure 4:
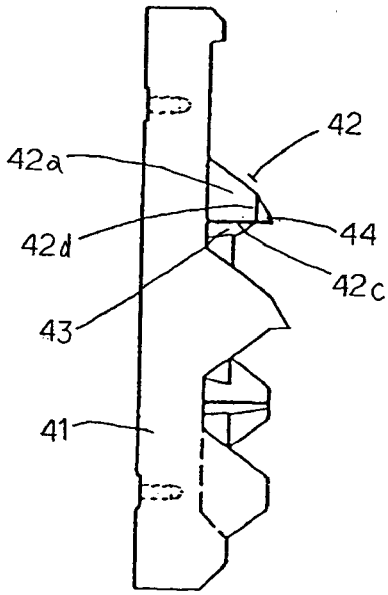
[FIG. 4]
Figure 5:
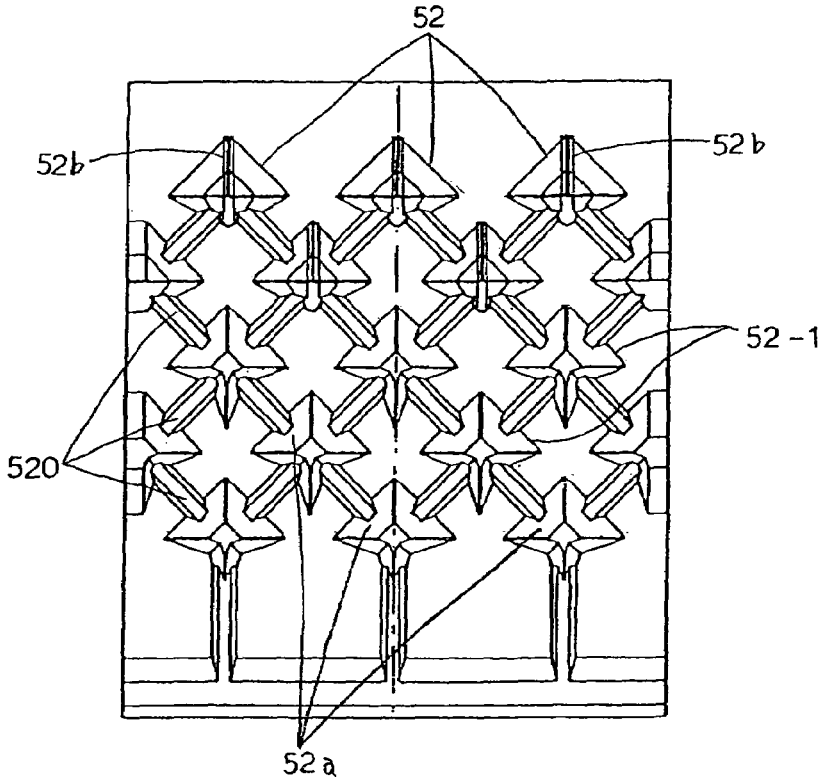
[FIG. 5]
Figure 6:
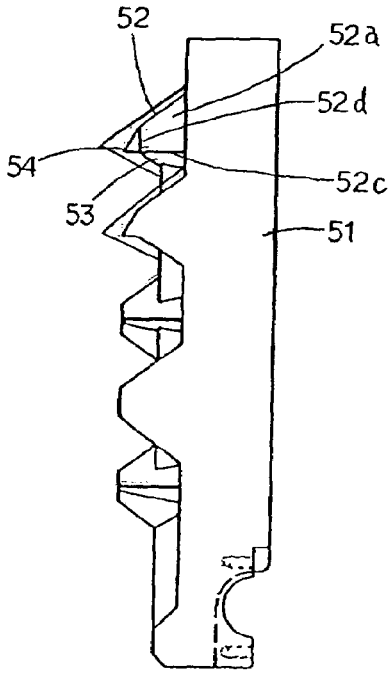
[FIG. 6]
Figures 7A, 7B, 7C:
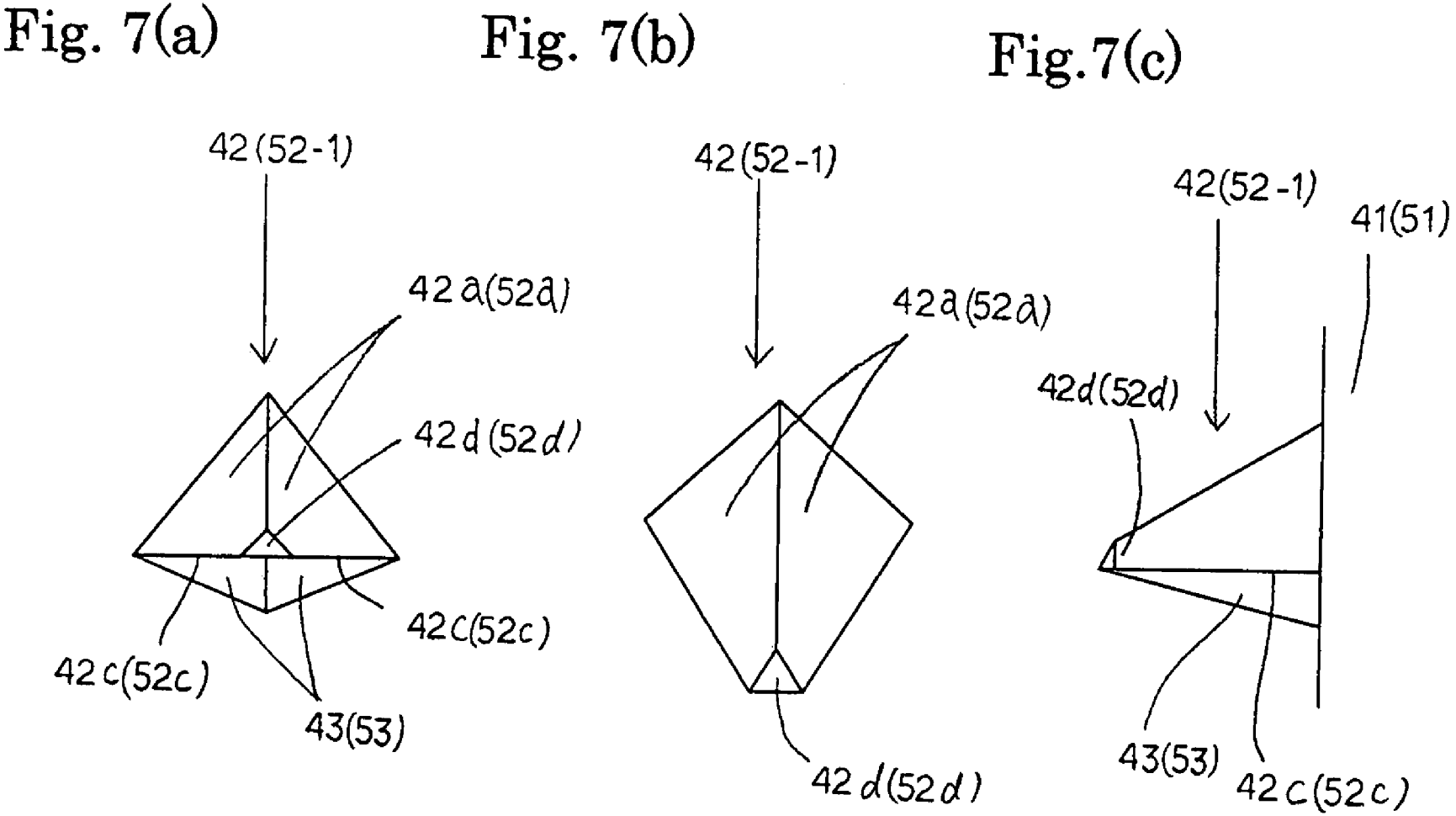
[FIG. 7]
Figure 8B:
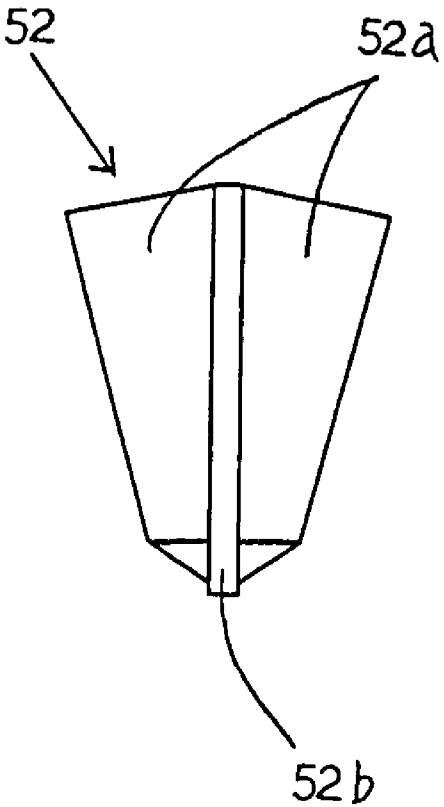
[FIG. 8]
Figure 8A:
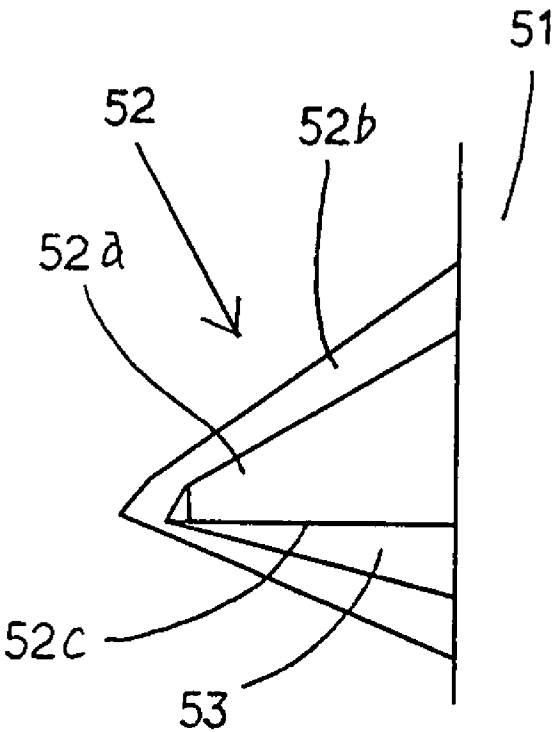
Figure 9B:
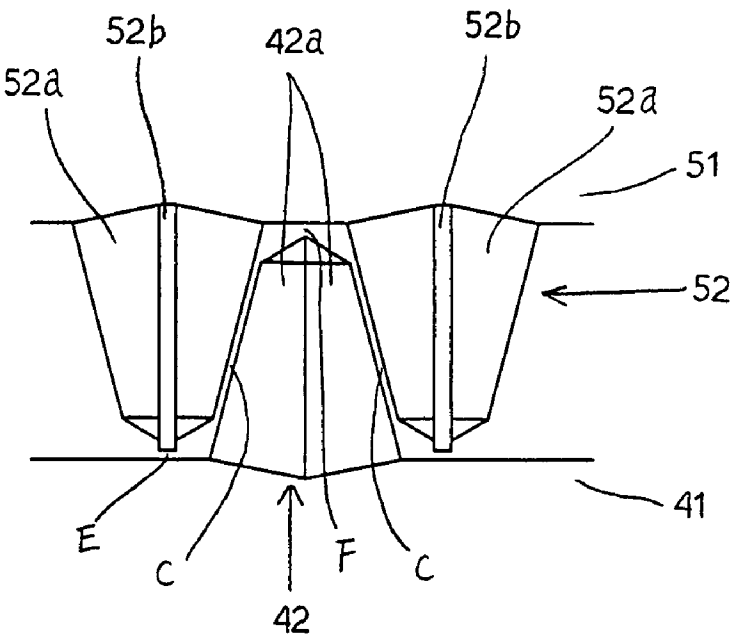
[FIG. 9]
Figure 9A:
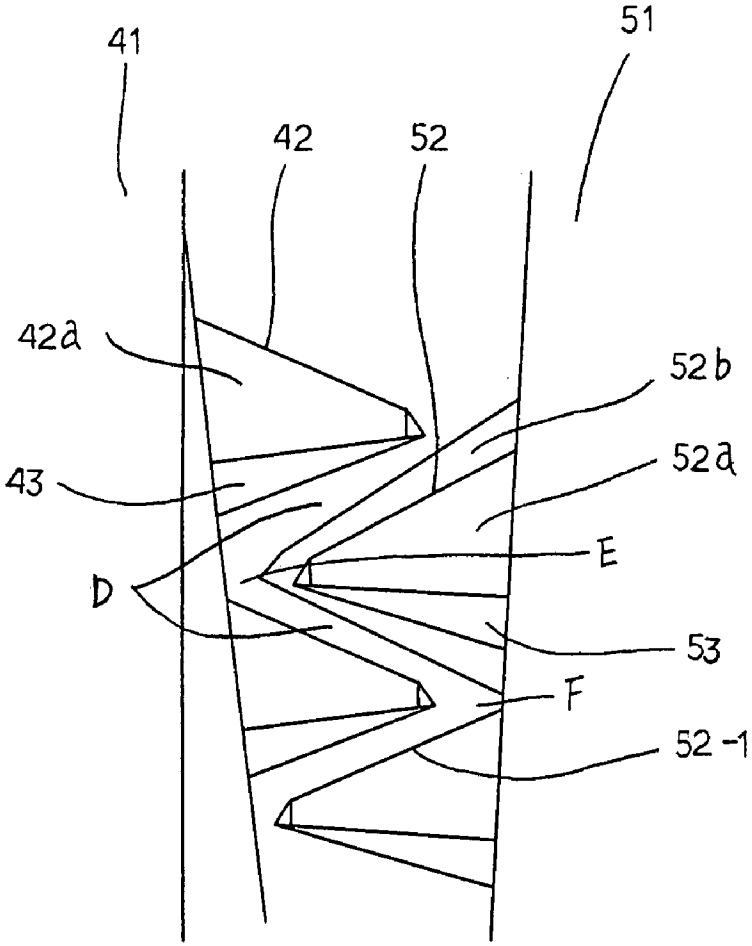
Figure 10B:
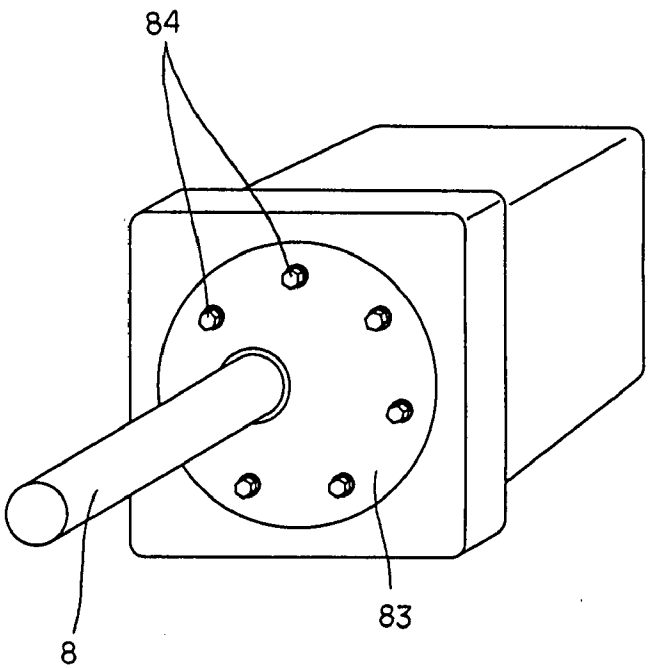
[FIG. 10]
Figure 10A:
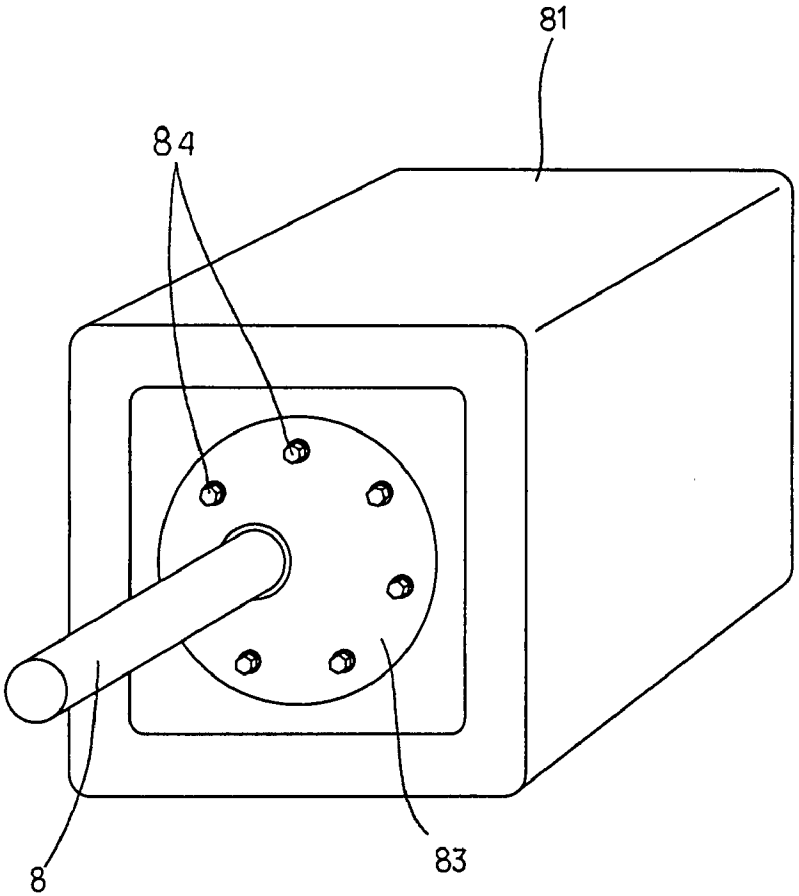
Figure 11B:
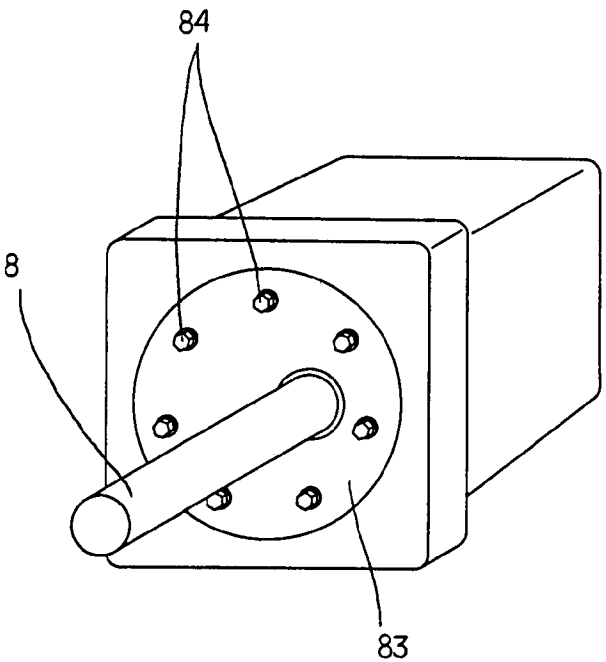
[FIG. 11]
Figure 11A:
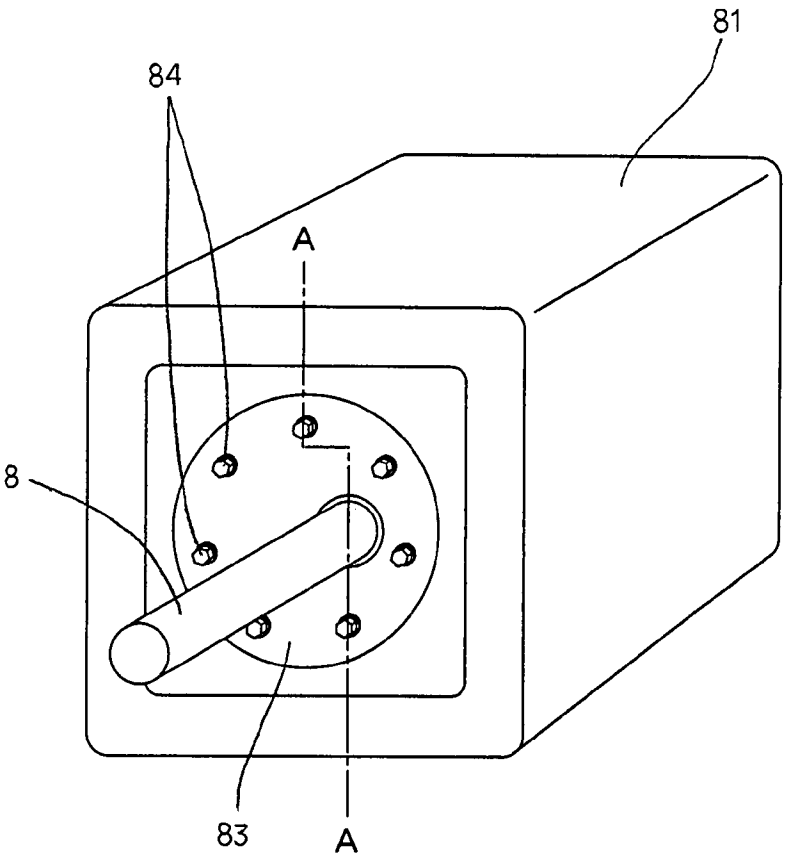
Figure 12:
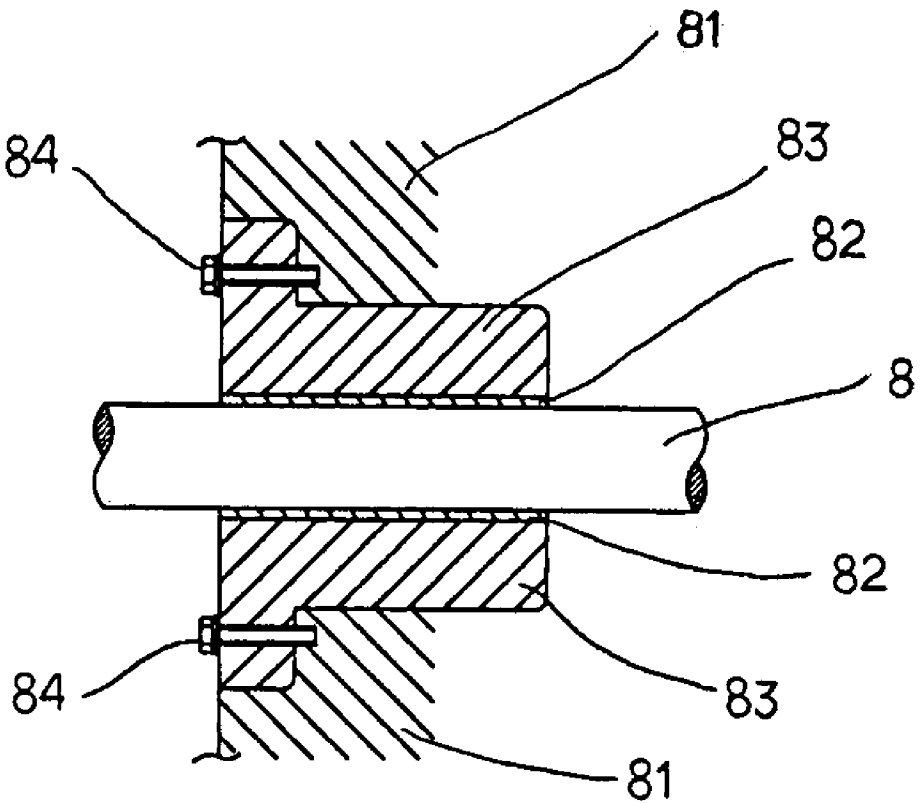
[FIG. 12]
Figure 13:
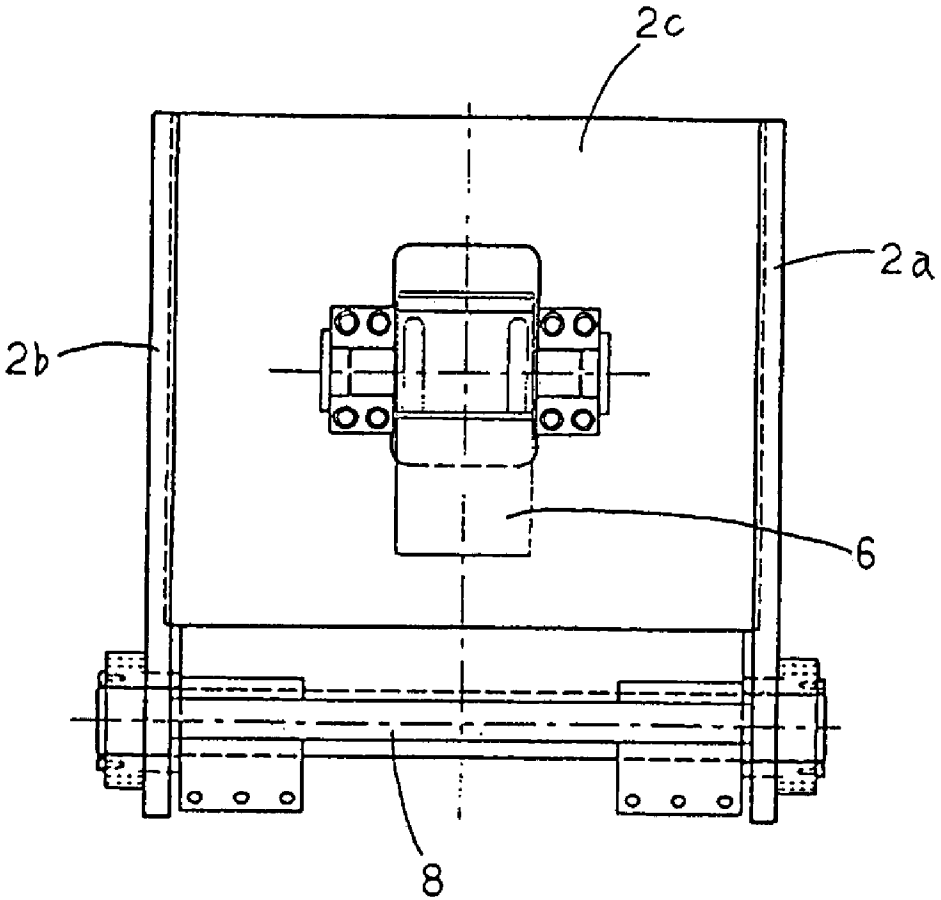
[FIG. 13]
Figure 14:
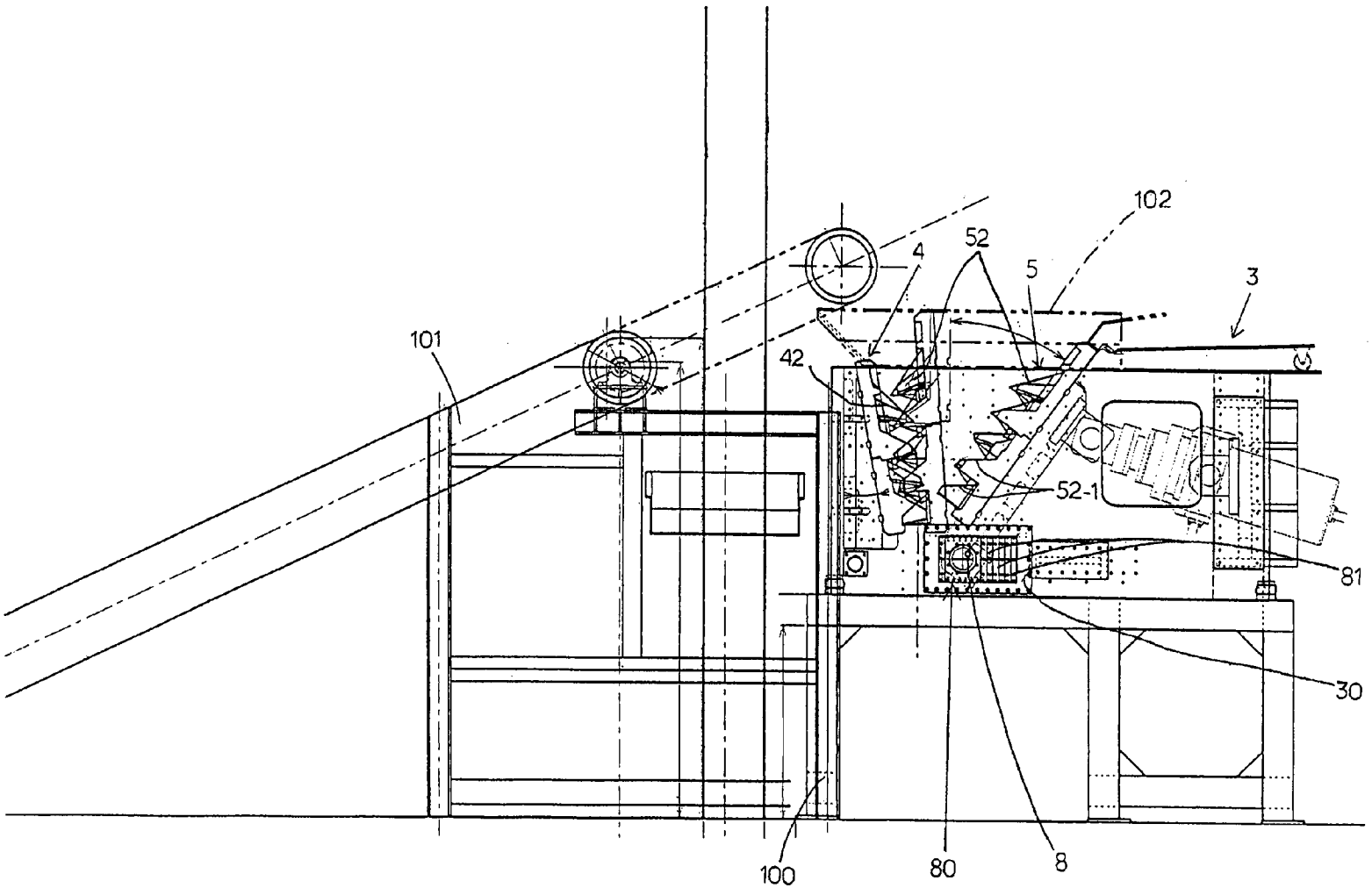
[FIG. 14]
Figure 15:
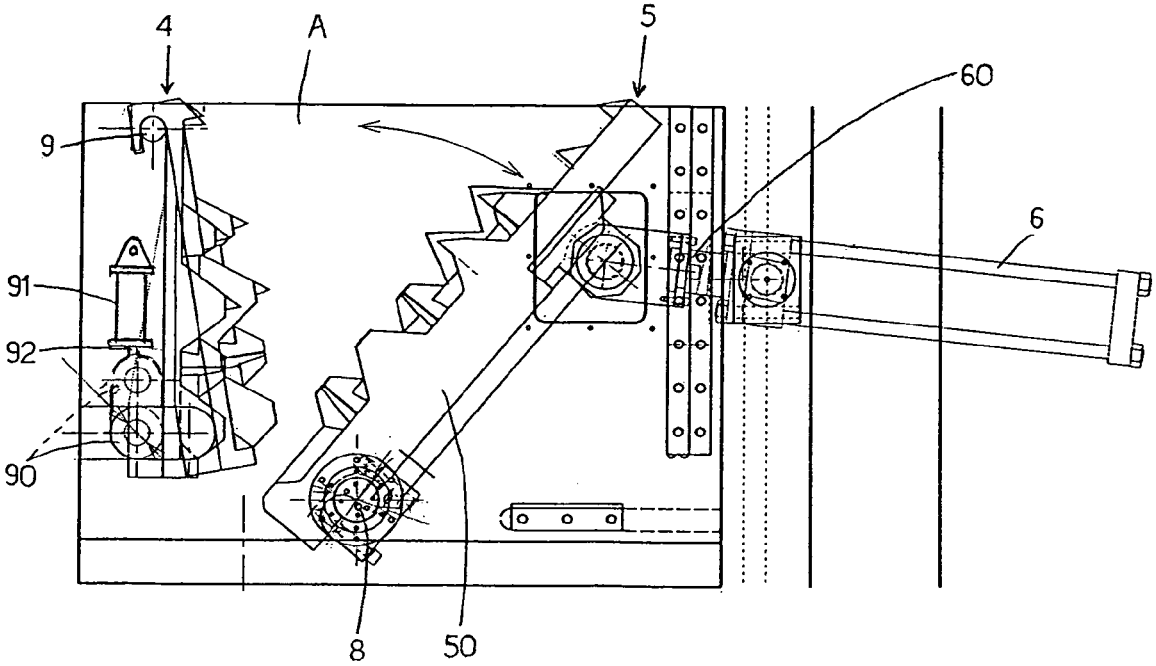
[FIG. 15]

The invention claimed is:

1. An aluminum shearing apparatus comprising:

a frame having two side plates;

one cutting edge unit provided between the two frame side plates and rotatably attached at an upper portion of two frame side plates;

a second cutting edge unit opposing to the one cutting edge unit, and being rotatably attached at a lower portion of the two frame side plates between the two frame side plates so that an the upper portion of the second cutting edge unit is movable;

half-cut pyramid-shaped cutting edges disposed respectively on the one cutting edge unit and the second cutting edge unit in a zigzag manner;

movable means supported by a beam plate supported between the frame side plates for moving the second cutting edge unit;

distal crests provided respectively on the distal sides of the respective half-cut pyramid-shaped cutting edges;

clearances for shearing provided between the half-cut pyramid-shaped cutting edges of the one cutting edge unit and the second cutting edge unit;

movable means for adjusting the opening for moving the lower portion of the one cutting edge unit;

an input opening provided above the one cutting edge unit and the second cutting edge unit; and a discharge opening provided below the one cutting edge unit and the second cutting edge unit.

2. The aluminum shearing apparatus according to claim 1, wherein a supporting shaft for rotatably attaching the lower portion of the second cutting edge unit provided between the two frame side plates includes eccentric bearings provided on the frame side plates.

3. The aluminum shearing apparatus according to claim 1, wherein the supporting shaft provided between the two frame side plates for rotatably attaching the lower portion of the second cutting edge unit is provided on the eccentric bearings provided on the frame side plates, and the eccentric bearing includes frame holes formed on the frame side plates, a number of supporting blocks inserted into the frame holes, eccentric bearings provided between the number of supporting blocks, and stoppers for stopping the rotation of the eccentric bearings.

4. The aluminum shearing apparatus according to claim 1 including projecting ridges formed at least on the top surfaces of the half-cut pyramid-shaped cutting edge of the one and the second cutting edge unit provided between the two frame side plates.

* * * * *